US006845872B2

(12) United States Patent
Delaney

(10) Patent No.: US 6,845,872 B2
(45) Date of Patent: Jan. 25, 2005

(54) SYSTEM FOR LIFTING AND MOVING AN OBJECT

(76) Inventor: François Delaney, Conceptions Françions79, rue de l'Industrie, l' Assomption (Quebec) (CA), J5W 2T9

( * ) Notice: Subject to any disclaimer, the term of this patent is extended or adjusted under 35 U.S.C. 154(b) by 0 days.

(21) Appl. No.: 10/073,286

(22) Filed: Feb. 13, 2002

(65) Prior Publication Data

US 2002/0158035 A1 Oct. 31, 2002

Related U.S. Application Data

(60) Provisional application No. 60/268,300, filed on Feb. 13, 2001.

(30) Foreign Application Priority Data

Feb. 13, 2001 (CA) ..... 2335897

(51) Int. Cl.[7] ..... B66C 7/00
(52) U.S. Cl. ..... 212/250; 212/197; 212/225
(58) Field of Search ..... 212/250, 341, 212/225–228, 196–198, 252, 336–338

(56) References Cited

U.S. PATENT DOCUMENTS 536,399 A * 3/1895 Sawers
560,125 A * 8/1896 Falkenau et al
700,162 A * 5/1902 Wiley
896,406 A * 8/1908 Maxfield et al. ..... 212/228
2,446,488 A * 8/1948 Pierce
2,476,192 A * 7/1949 Hall
2,562,066 A * 7/1951 Scott et al.
3,531,963 A * 10/1970 Garner et al. ..... 72/31
3,580,133 A * 5/1971 Berthiez ..... 90/11
3,658,187 A * 4/1972 Campbell et al. ..... 212/3
3,899,963 A * 8/1975 Tremper ..... 100/25
4,196,486 A * 4/1980 Capra ..... 15/53 A
4,955,923 A * 9/1990 Hageman ..... 14/71.7
5,059,086 A * 10/1991 Thierion ..... 414/626
6,068,240 A * 5/2000 Leveugle ..... 254/277
6,176,170 B1 * 1/2001 Uppgard et al. ..... 91/422

FOREIGN PATENT DOCUMENTS

| | | |
|---|---|---|
| DE | 2 918 010 | 11/1980 |
| DE | 30 02 577 | 7/1981 |
| EP | 0 254 840 | 2/1988 |
| FR | 2 764 591 | 12/1998 |
| JP | 6 126 664 | 5/1994 |
| JP | 9 317 807 | 12/1997 |
| SU | 1 781 156 | 12/1992 |
| WO | WO 98/15487 | 4/1998 |

* cited by examiner

*Primary Examiner*—Thomas J. Brahan

(57) ABSTRACT

A system for lifting and moving an object includes a vertical post (2), having a transversal lifting arm (38) rotatably connected thereto for rotation about a vertical axis thereof. The vertical post includes a weight (5) acting as a piston connected to a carriage (50) slidably mounted on the lifting arm, such that down and up displacements of the weight by gravity or pressurized fluid respectively lower and raise the object accordingly.

20 Claims, 12 Drawing Sheets

6
6
8
B
25
5
7
C
29
38
26

3
1
34
2
33

13
15
14
16
12
10
11
17

SYSTEM FOR LIFTING AND MOVING AN OBJECT

CLAIM OF PRIORITY

This application claims priority under 35 USC § 119(e) to U.S. patent application Ser. No. 60/268,300, filed on Feb. 13, 2001, the entire contents of which are hereby incorporated by reference.

TECHNICAL FIELD

The invention relates to apparatuses for lifting objects and displacing them from one location the other.

BACKGROUND ART

Many apparatuses for lifting and moving objects from one location to the other are known. Various apparatuses used to lift abject and displace them from one location to the other using lateral arms and counter weights are known. See for example Japanese Patent Application of Motoda published under no. 06126664. Other known apparatuses used hydraulic or pneumatic pistons connected to lateral arms using pulleys. See for example U.S. Pat. No. 536,399 (Sawers), U.S. Pat. No. 560,125 (Falkenau et al.), U.S. Pat. No. 700,162 (Wiley), U.S. Pat. No. 2,446,488 (Pierce), U.S. Pat. No. 2,476,192 (Hall), U.S. Pat. No. 2,562,066 (Scott et al.), PCT Application no. WO98/15487 (Vestin), European Patent Application published under no. 0 254 840 (Gebauer), German Patent 30 02 577 (Shrouder et al.), German Patent 29 18 010 (Häring), Russian Patent 1,781,156 and French published application no. 2,764,591 (Foillard et al.). However, they are cumbersome to use and costly to manufacture.

SUMMARY OF THE INVENTION

This apparatus has three distinct objects:

a) Cancel the mass of an abject to be lifted by a weight;

b) Allow the operator to lift and lower an abject with ease; and c) Move an object with a radius between two to 12 feet at 360 degrees.

It is impossible to abuse or break this equipment due to the fact that it can only lift an object using 99% of the mass of the weight. Friction of mechanical elements is the reason for the 1% loss.

Using the supporting post as the compression chamber allows 360 degree continuous movement.

The proximity of the two pulleys of the carriage supporting the object attachment member via the cable induces a braking effect in the event the operator would try to raise the object too high because of the local angle provided to the cable between each pulley and the object attachment member.

The invention relates to a system and apparatus to lift and move an abject from one location to another, composed of:

a. a partially hollow post having a generally vertical axis;

b. a weight disposed within said post and defining a post chamber thereunder, said post chamber being fillable with a pressurized fluid;

c. a weight displacement system longitudinally and upwardly displacing the weight relative to said post, said weight displacement system controlling pressure inside said post chamber so as to selectively position said weight along said post;

d. a transversal arm rotatably connected to said post for rotation about said vertical axis and including a proximal longitudinal end located near said post and a distal longitudinal end located away from said post;

e. a cable having one end attached to said weight and the other end attached to said distal end of the transversal arm;

f. a carriage connecting to said cable and mounting on said transversal arm; and g. an object attachment member connecting to said cable for attaching the object thereto;

whereby the object is being lifted via said cable upon downward displacement of said weight relative to said post under gravity and being lowered upon upward displacement of said weight relative to said post under pressurized fluid within said post chamber.

DESCRIPTION OF A PREFERRED EMBODIMENT

Figures 1A, 1B, 1C:
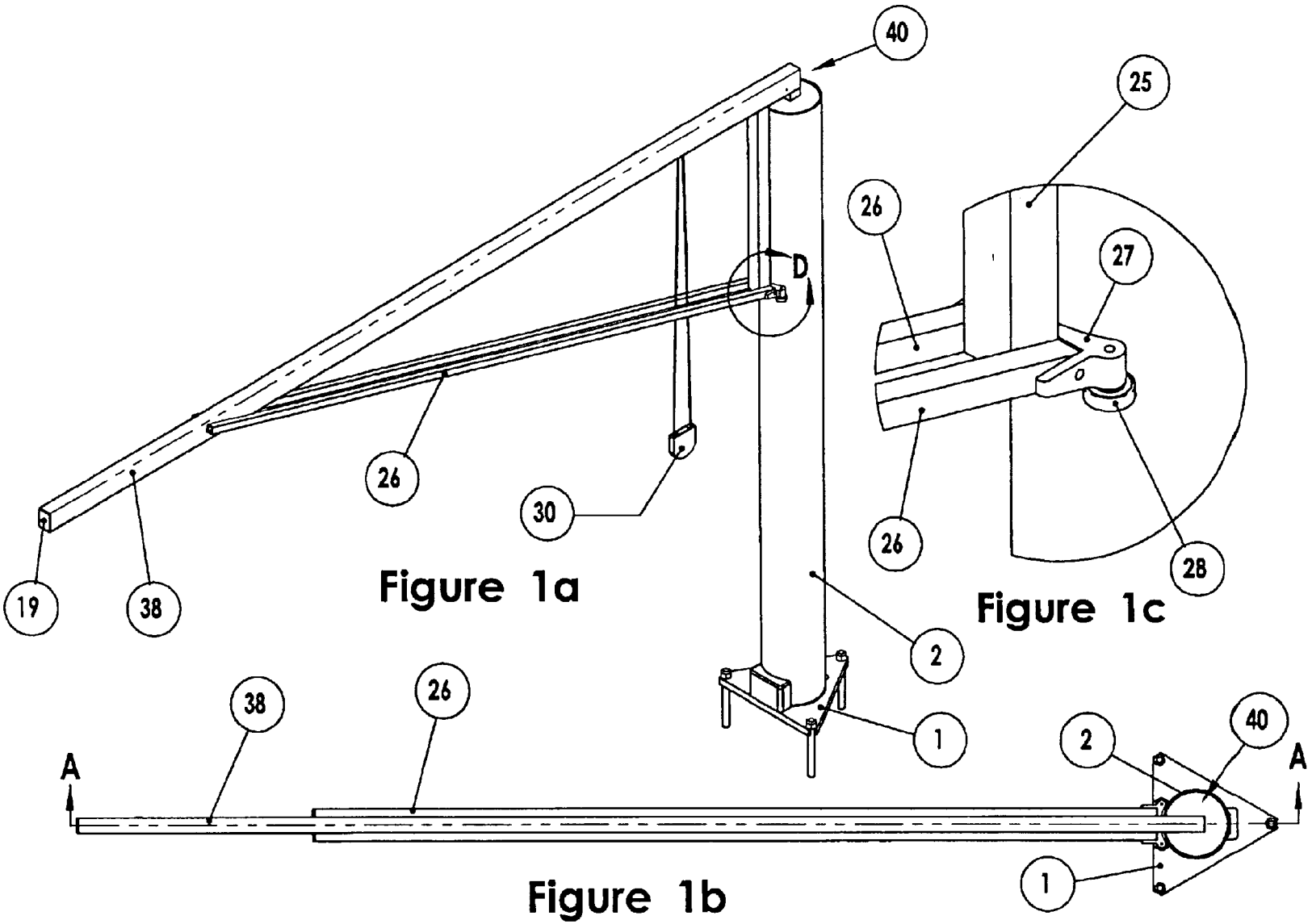
FIG. 1*a* is a perspective view of a lifting system in accordance with the invention.
FIG. 1*b* is a top view of the system shown in FIG. 1*a;*
FIG. 1*c* is a detailed view of the portion of FIG. 1*a* shown in "D"
Figure 2:
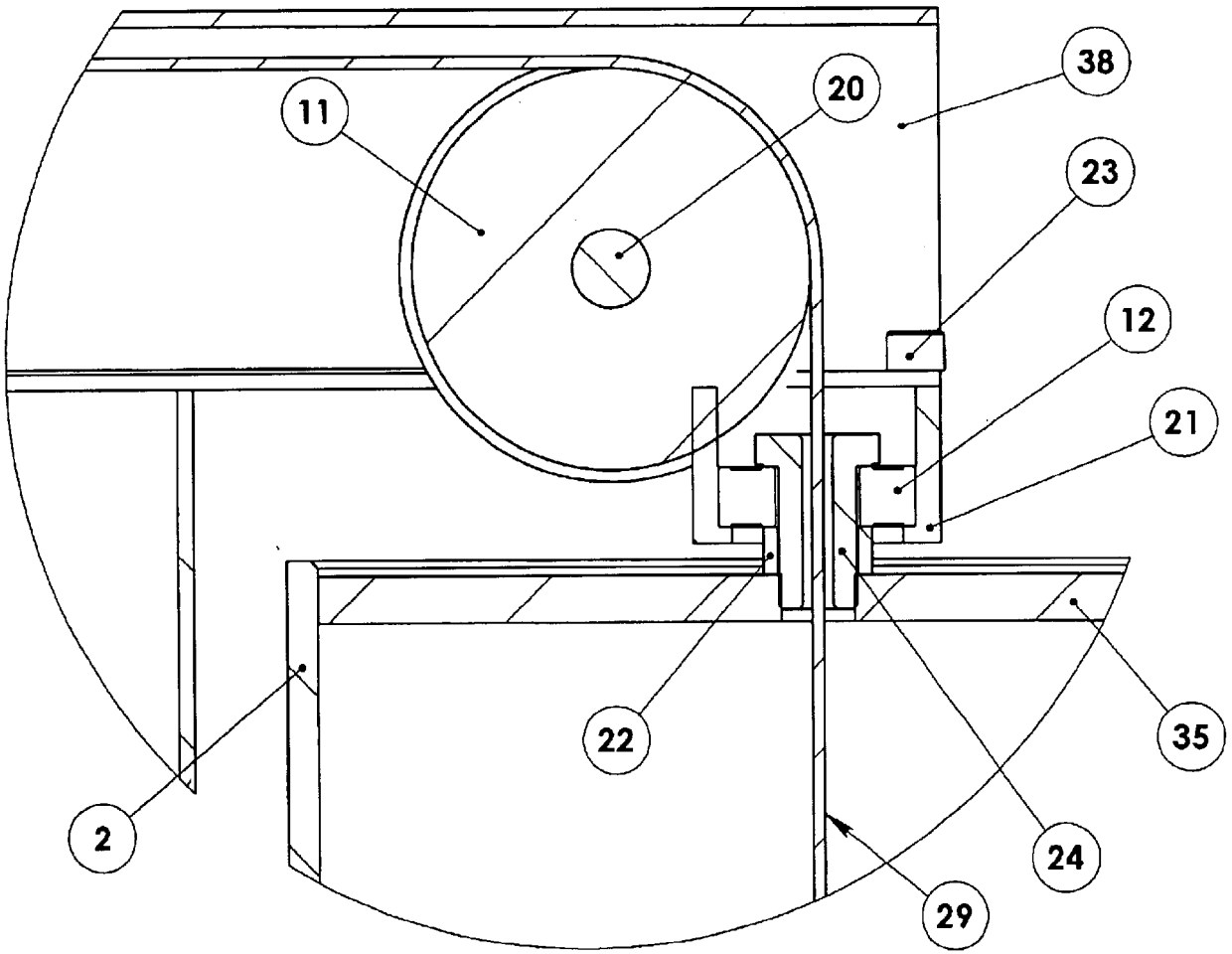
FIG. 2 is a detailed view of the portion of FIG. 3*a* shown in "B"

The apparatus consists in a generally transversal arm or rail (38) fastened to the top of a post (2). For example, the rail (38) may be 12 foot long steel rail and the post may be a cylindrical steel post having an 8 inch diameter. The height of the post is selected in accordance with the limitation of the work area (for example 8 to 12 feet in height).

A weight (5) is disposed inside the hollow post (2) in such a way that it may be raised and lowered within the post. Sealing means (6), such as joints or o-rings, are disposed around the weight so as to seal the space between the weight and the interior of the post. The sealing means are preferably provided with an opening to allow a predetermined flow of air or gas to pass therethrough.

The rail (38) is fastened to the post (2) with the use of a rotating joint (40), or arm connecting system, which allows its unlimited and unobstructed continuous 360°, and more, movement around the post about the post axis.

A hole is provided in the rotating joint (40) to allow the free movement of a cable (29) while the weight (5) rises or lowers. As shown in FIGS. 2, 10, 11 and 12, the rotating joint (40) is located in the center of a cover (35) attached to the top of the post (2). Cable (29) passes through a guide (24) and around a pulley (41) which turns around an horizontal axis (20). A bearing (42) is disposed between guide (24) and support cylinder (21) which is fixed to the rail (38) by bolts (23) or other known means. A spacer (22) is disposed between cover (35) and support (21).

The rail (38) is supported by two elongated supports or braces (26) having one longitudinal end fixed to the rail (38) and the opposed longitudinal end attached by bolts or other known means to a rolling block (27). The rolling block (27) can move laterally in a tangential direction on the outside of the post (2) with the help of two bearings (28). A generally vertical support brace (25) positioned parallel to and in close spaced apart relationship relative to the post (2) has one end fixed to the proximal end of the rail (38) and the other end fixed to the rolling block (27). The vertical brace (25) that ensures rigidity to the system maintains the rolling block (27) at a predetermined distance away from the rail (38).

Figures 3A, 3B, 3C:
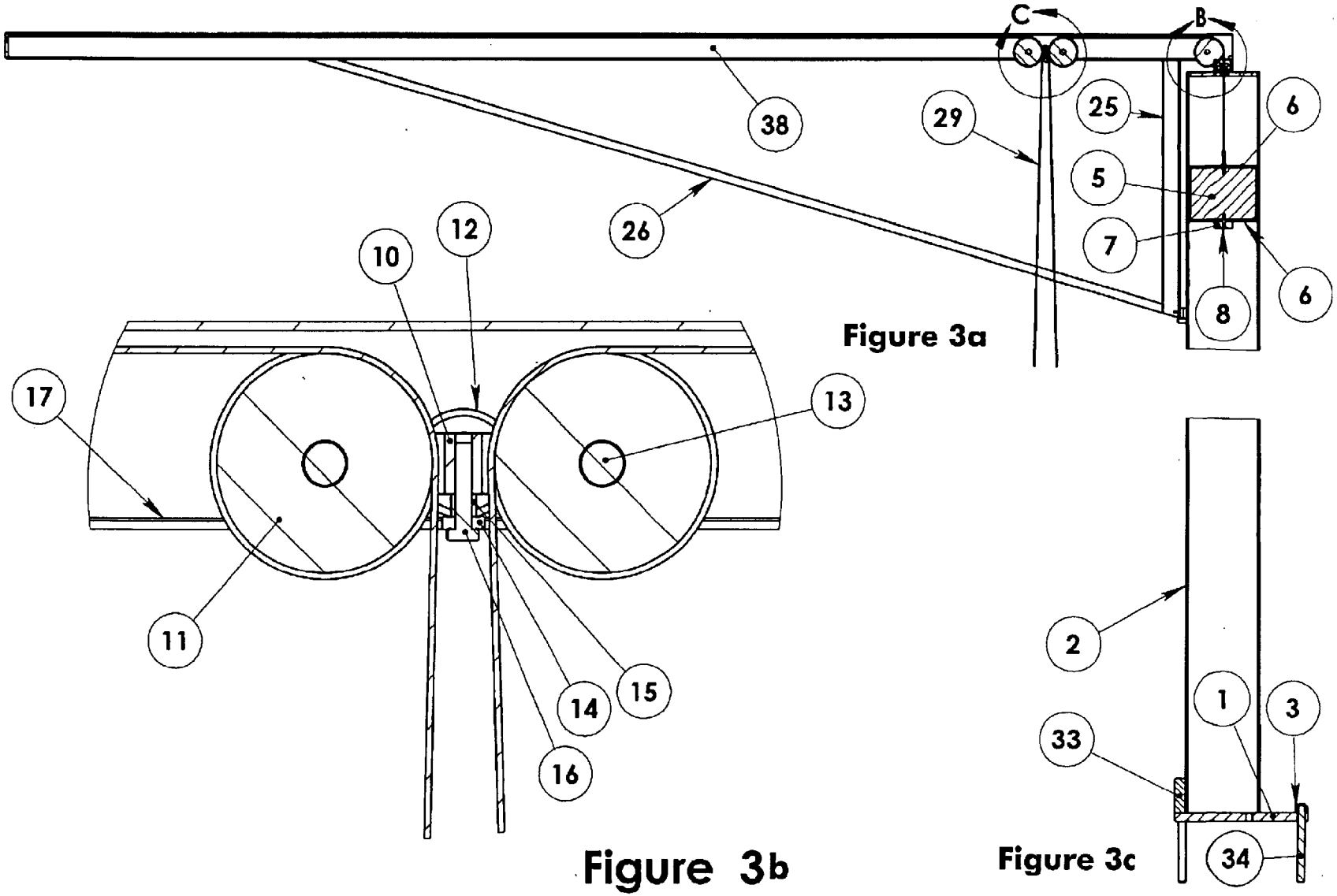
FIG. 3*a* is a partial cross-section of the system along line A—A in FIG. 1*b;*
FIG. 3*b* is a detailed cross-sectional view of the portion of FIG. 3*a* shown in "C"
FIG. 3*c* is a partial cross-sectional side view of the base of the system shown in FIG. 1*a;*
Figure 4:
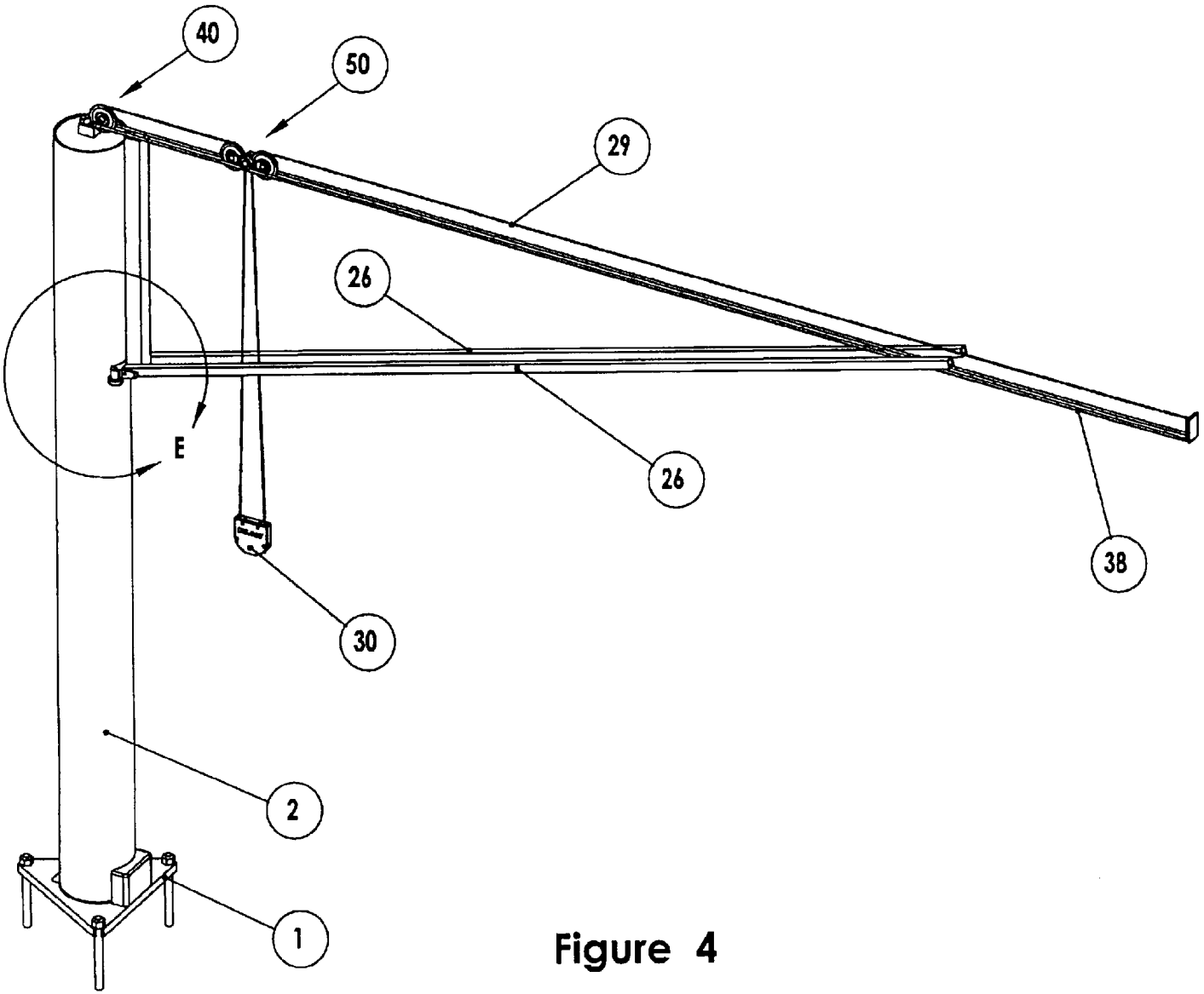
FIG. 4 is another perspective view of a lifting system in accordance with the invention.
Figure 5:
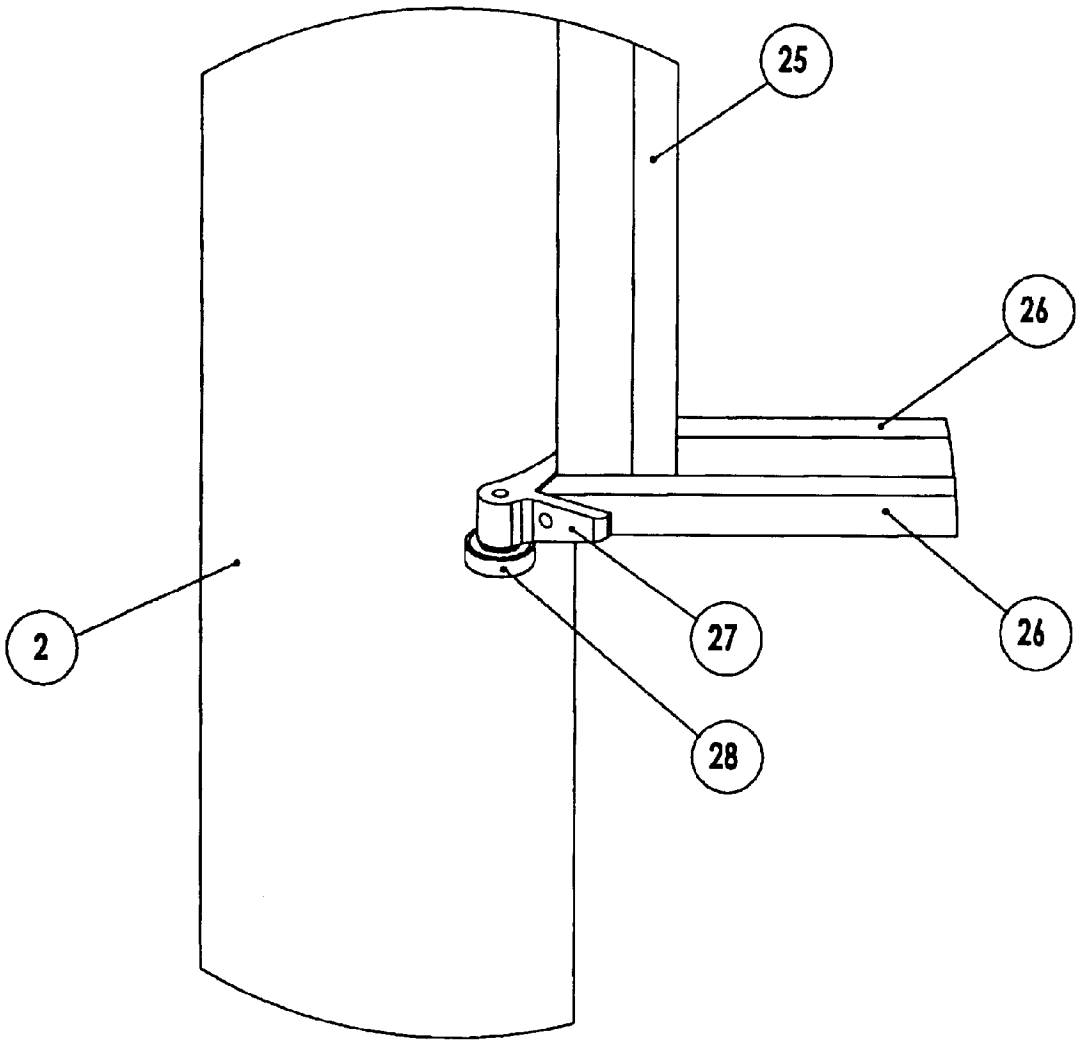
FIG. 5 is a detailed view of the portion of FIG. 4 shown in "E"
Figure 6:
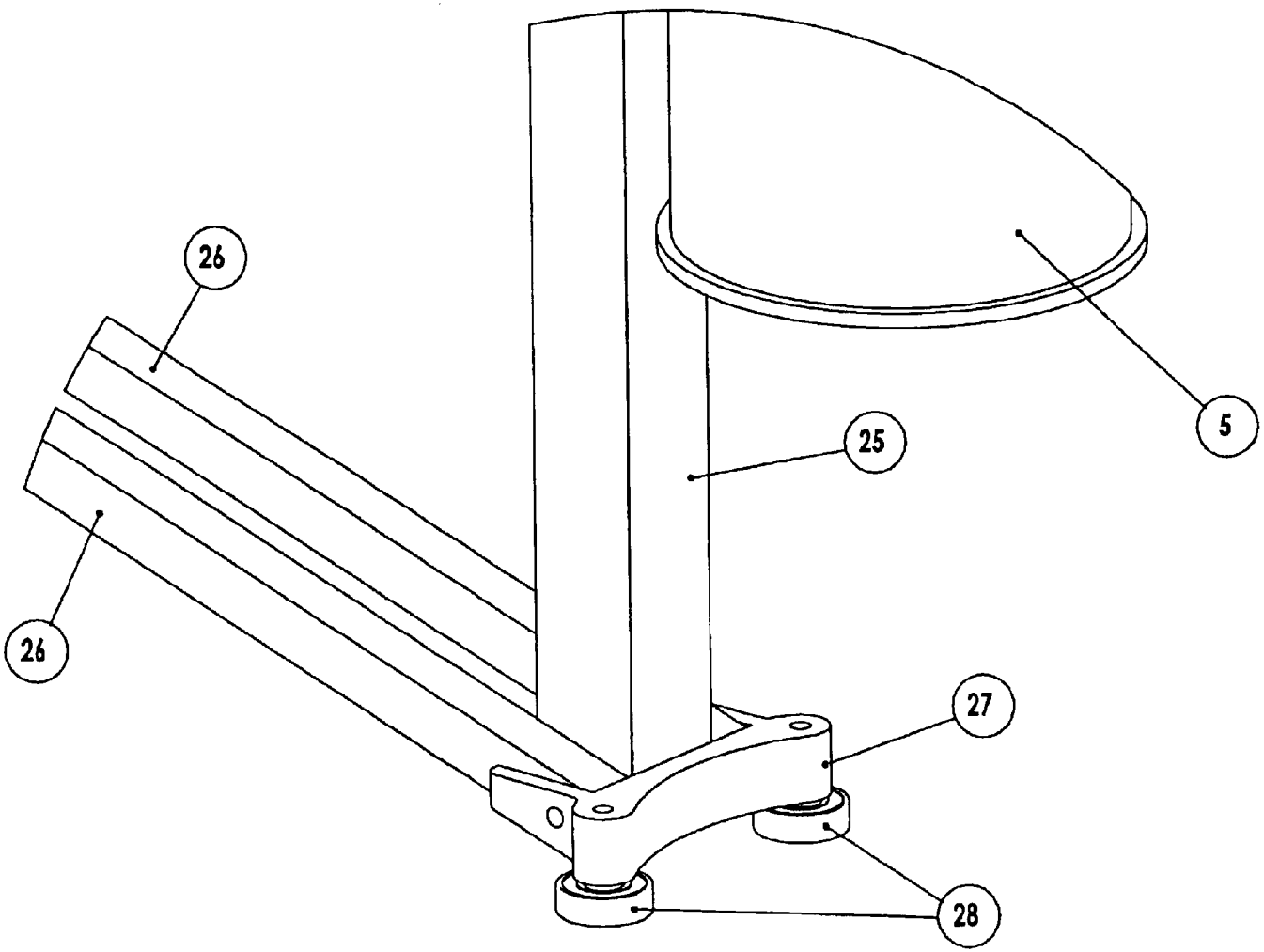
FIG. 6 is another partial view of the portion of FIG. 4 shown in "E" with sections taken out.
Figure 7:
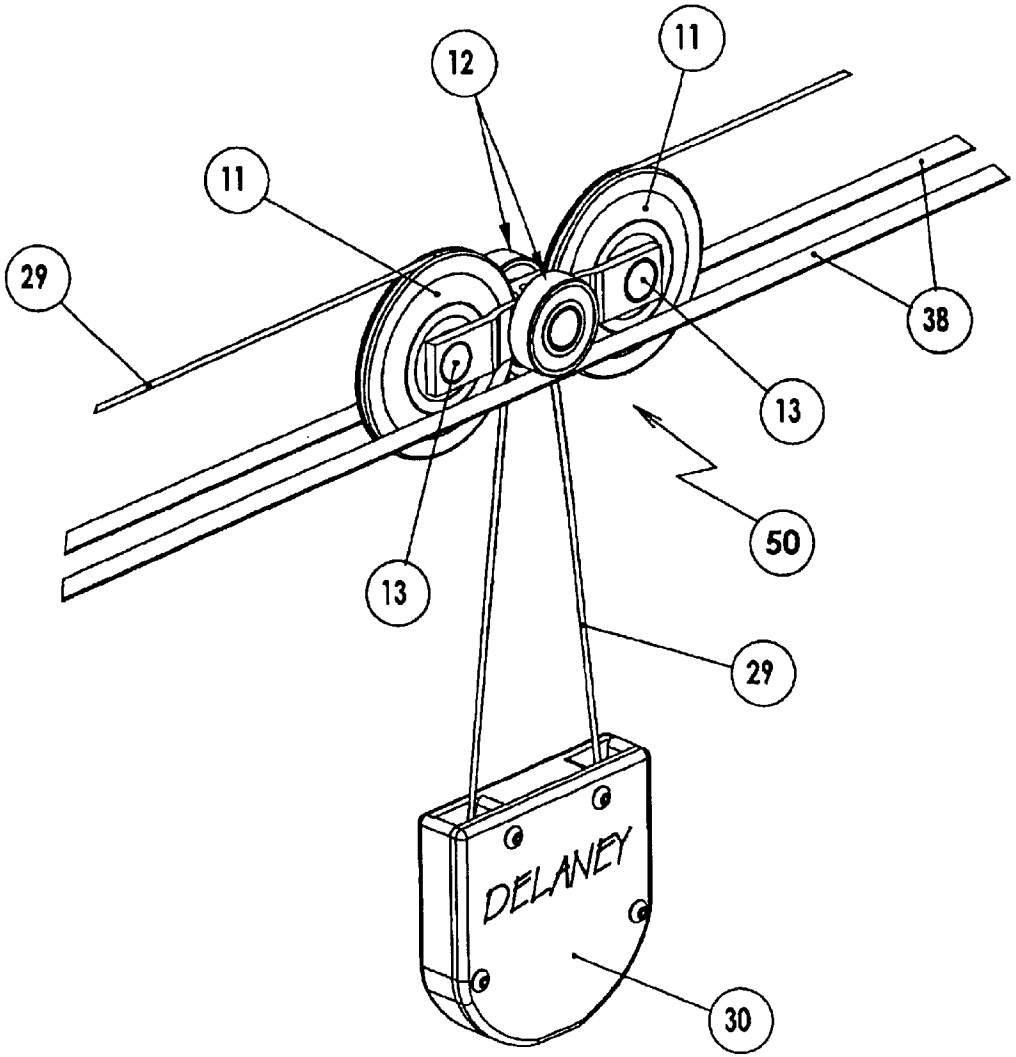
FIG. 7 is a perspective view of a pulley sub-system of the carriage for use with a system in accordance with the invention.
Figure 8:
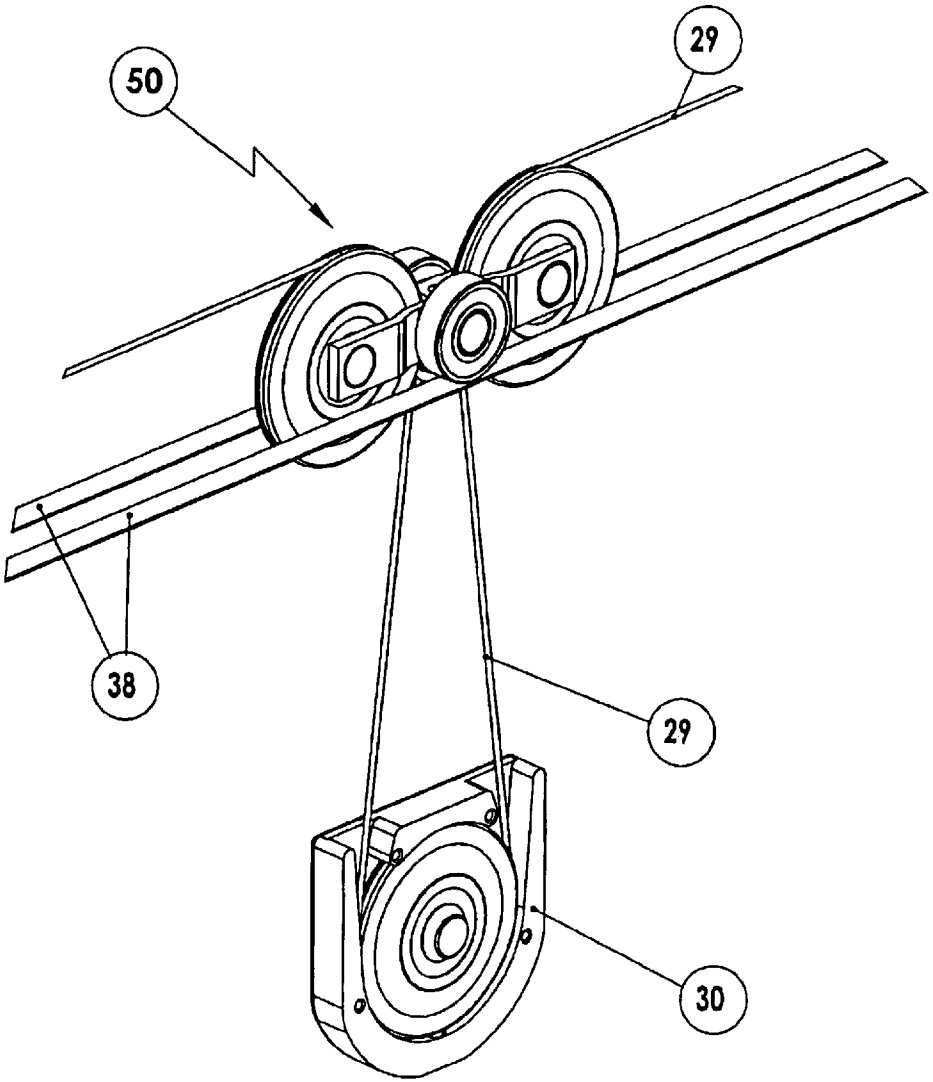
FIG. 8 is another perspective view of a pulley sub-system shown in FIG. 7 in which a portion of the pulley housing of the attachment block has been removed.
Figure 9A:
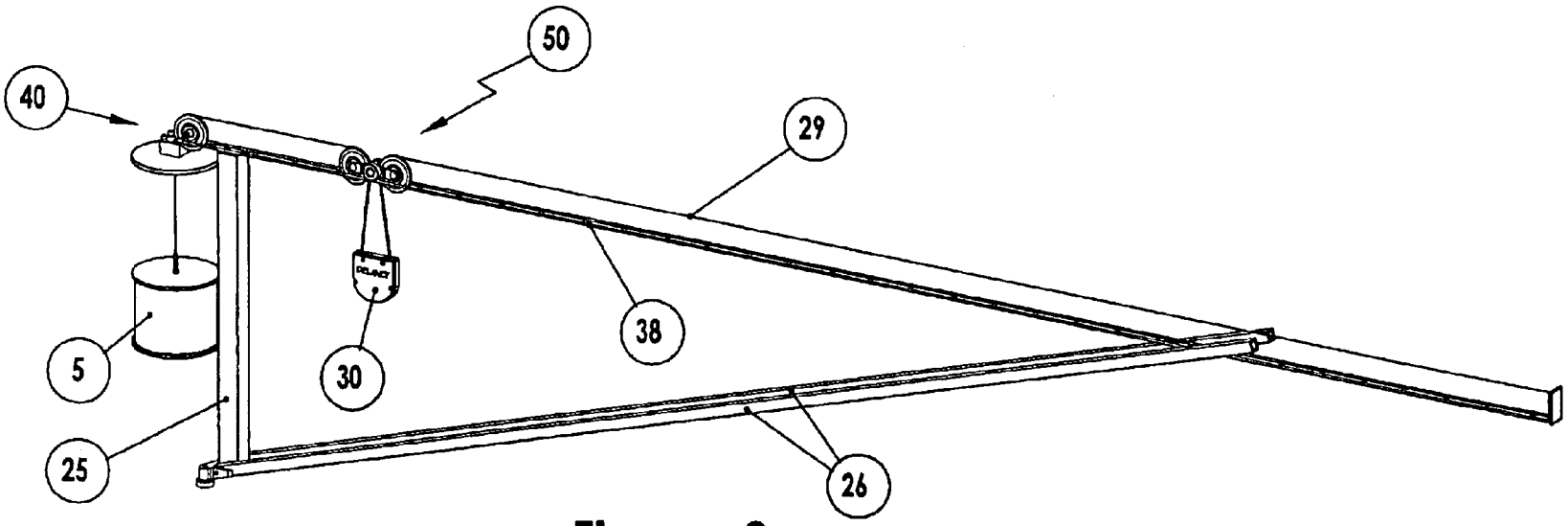
FIG. 9 is a perspective view of an arm sub-system for use with a system in accordance with the invention.
FIG. 9*b* is a perspective view of a base for use with a system in accordance with the invention.
Figure 9B:
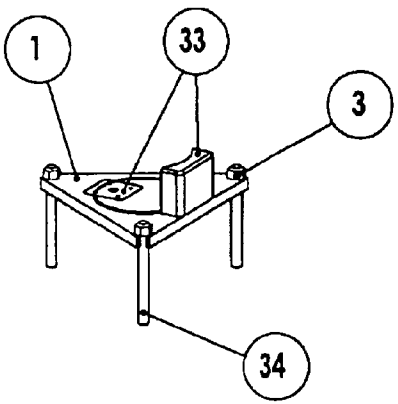
Figure 10:
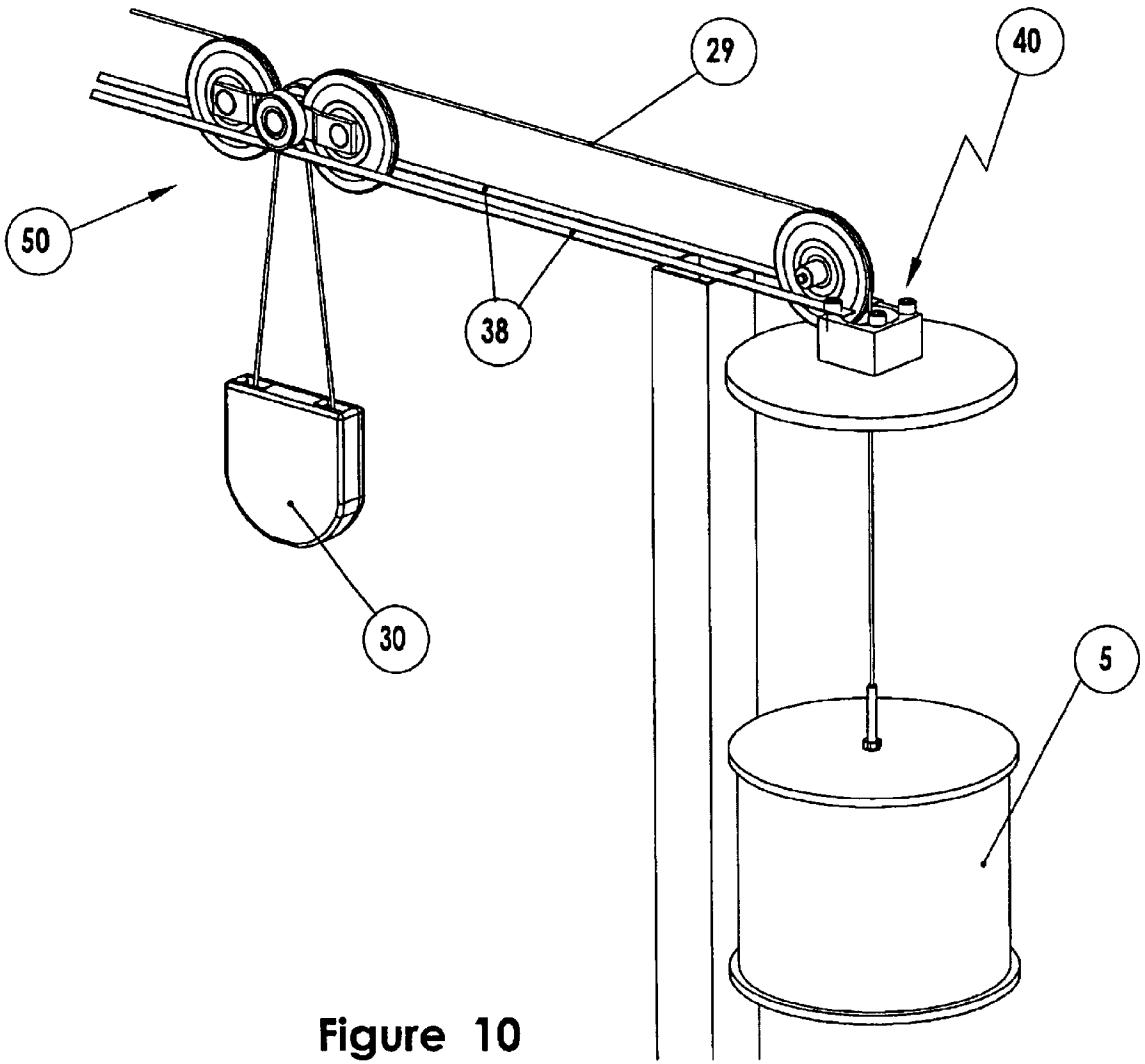
FIG. 10 is a perspective view of a cable sub-system for use with a system in accordance with the invention.
Figure 11:
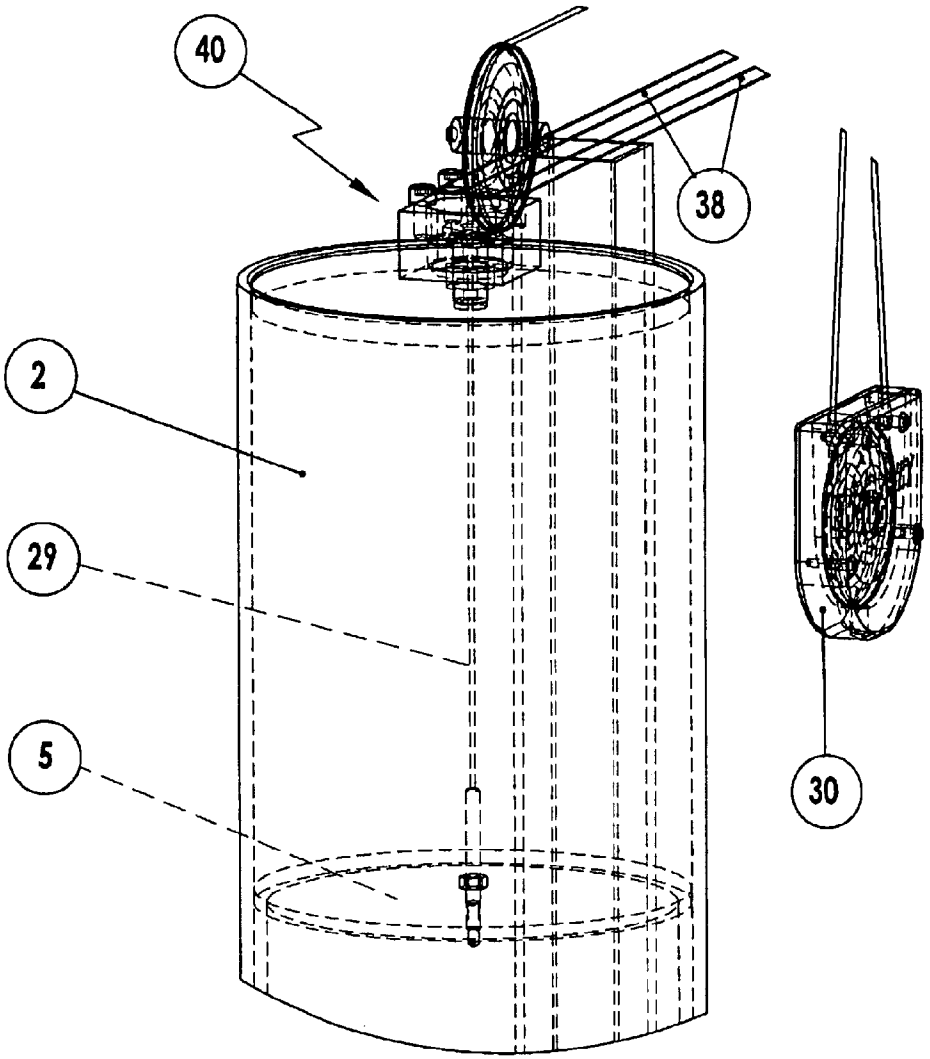
FIG. 11 is a partial perspective view of a pulley sub-system for use with a system in accordance with the invention.
Figure 12:
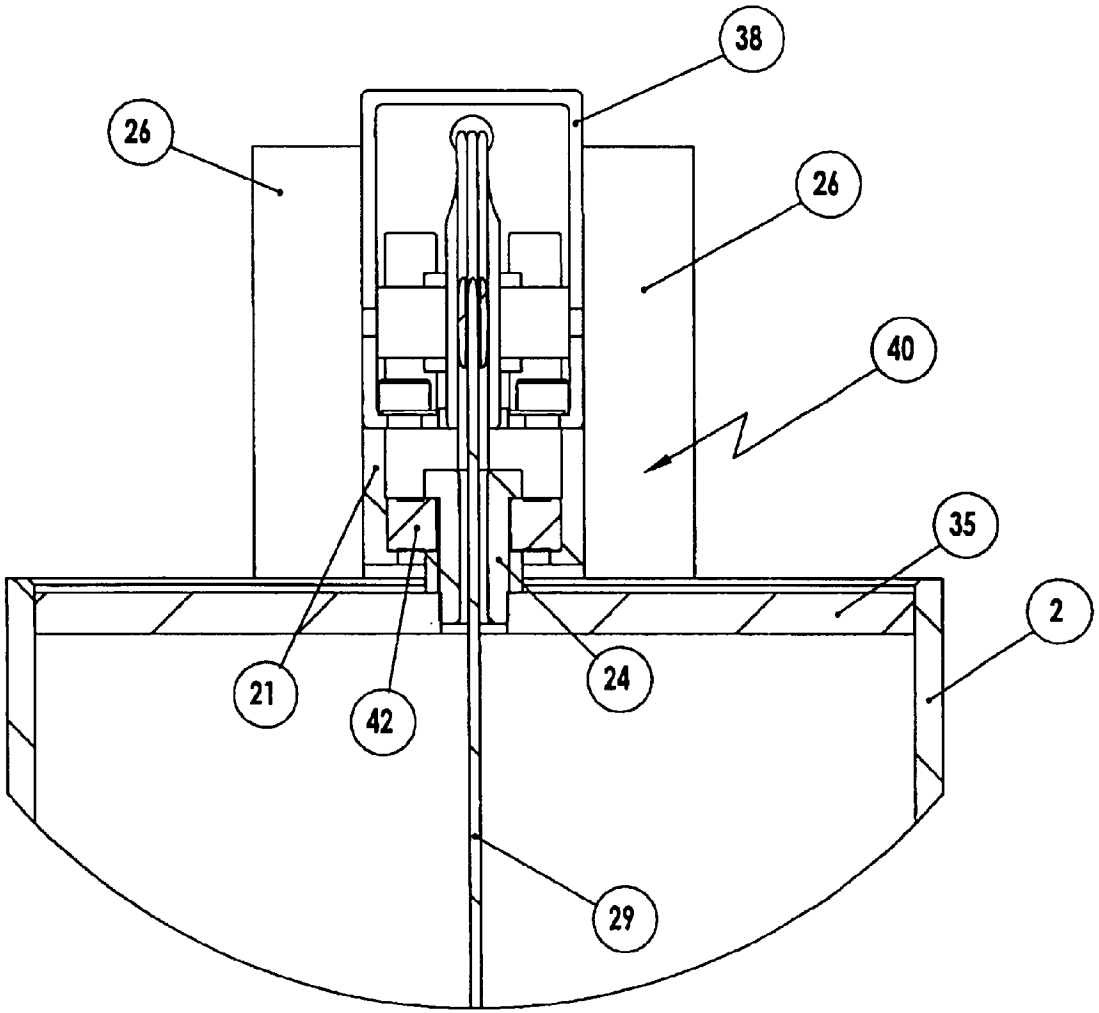
FIG. 12 is a partially broken section view of an arm rotating joint for use with a system in accordance with the invention.

A small carriage (50) is installed inside the rail (38) to allow the load to move freely along the rail (38). As illustrated in FIGS. 3*b*, 7 and 8, the small carriage (50) comprises two generally coplanar pulleys (11) turning around an axis (13) around which is disposed cable (29). The carriage (50) also includes a wheel (12) disposed on each side of the carriage (50). These generally coaxial wheels (12) are placed on rolling surfaces (17), for example a pair of hard steel strips disposed inside the rail (38). A bearing (14) is fixed to a vertical axis (16) to insure the alignment of the carriage within rail (38).

One end of cable (29) is attached to weight (5). Cable 29 then is wrapped partially around one of the cable pulley (11) mounted on the carriage (50). Cable (29) then goes down to an object attachment member such as an attachment block (30) to which a hook, pincer or other means to attach a load is fixed. Cable (29) is then partially wrapped around a pulley within attachment block or member (30) (see FIG. 8) before returning to the second cable pulley (11) in the small carriage (50). From there, cable (29) reaches the other end of the rail (38) where it is attached to a cap (19) or other similar means.

Attachment block (30) also preferably is used as a small weight to ensure that cable (29) is maintained in tension such that it will not easily fall off from pulleys (11).

In the embodiment shown in the figures, the bottom of the post (2) is welded to a triangular base (1) anchored to the floor with (for example concrete anchors (3, 34) cast in epoxy). However, other known means may be used. The post (2) could also be fixed to a mobile base provided means are used to ensure that the post remains substantially vertical.

A sealing member is preferably made out of two seals in the form of plastic rings (6) are installed on top and bottom of the weight (5) to prevent friction between the piston/weight (5) and the interior of the post (2). They are configured to let air or other gazes leak at a predetermined rate, depending on the need.

A weight displacement system such as a valve (33) allows the control, the inflow of pressurized air stored in a source reservoir or generated by a compressor (not shown) within the post (2) under the weight (5) so as to lift the weight.

The predetermined air flow passing through the seal (6) around weight (5), the valve (33) or other similar means or a combination thereof allows the control of the outflow or removal of the air under the weight (5) so as to allow it to be lowered by gravity with the object attached thereto via the cable (29) being raised.

Weight (5) preferably has the following characteristics:

1. The weight also acts as a piston.
2. Its rising movement is made possible with low air pressure at four pounds per square inches (4 PSI).
3. The sealing principle of the weight (piston) is to use air friction when it is moved through a small opening or crack (not shown). This principle allows the creation of air pressure below the piston using very little air.
4. Another advantage with this principle is the fact that the small air leak created causes the piston to stay centered in the tube and eliminates the wearing effect between the weight (5) and the interior of the post (2).
5. Along with insuring guiding and sealing, the use of this leaking system eliminates the need to pressurize the top of the piston or the use of an air exhaust valve. This system requires only the reduction or closing of the air intake to allow the weight to lower simply by gravity thus raising the object.

The weight (5) may be of variable weights. In such a case, it may be equipped with a trap or other known means on the bottom that allows rapid emptying. This container is preferably open on top. A tank installed on top of the apparatus can be filled with granular material or liquid using quiet moments. A trap or other known means on its bottom is used to fill the weight container as required.

The granular material or liquid can be raised to the tank by using a ¼HP small conveyor system with jars or buckets in a continuous movement.

Management of the weight can be made possible by using liquids (water, oil, mercury) or granular material (sand, steel balls, polymeric balls). If mercury is chosen, everything must be done in closed circuit in order to avoid possible environment contamination. It must be noted that mercury has the advantage of being very compact although extremely expensive.

A piece of rubber (7) bolted or otherwise attached to the bottom of the weight eliminates impacts when lowering.

Operation

This equipment is a lifting arm (38) allowing easy handling of any solid object through an attachment block (30) which can be held by a suction disc, a magnet, a hook or any other holding system. When a 12 foot arm is used, the operator can handle the object within a diameter of 24 feet and controls the lifting and lowering by a remote control either wireless or connected. The stand on which the remote control is installed is also preferably used as a handle for the operator at the base of the lifting system. The lifting system can be of any applicable shape.

Using a melamine-coated sheet as an example, the operator inserts air under the weight (5). As a result, the holding system (in this case the suction disk) lowers on top of the sheet. Once the sheet is appropriately held, he/she releases the air and the weight is allowed to lower with the effect of gravity thus lifting the sheet. The operator can then move the sheet where required and reinsert air under the weight to force it to raise thus lowering the sheet. Finally, he/she releases the sheet and is ready for another manoeuver.

The equipment shown in the figures is designed to handle small charges varying from 50 to 150 lbs. However, it is possible to build an apparatus to lift heavier loads by making the necessary changes to the weight (5) and insuring that the other components are properly sized.

The weight (5) which also acts as a piston is placed inside the vertical post (2). The piston (5) may move up and down, preferably under pressure created by a gas or a fluid underneath the piston. It is also possible to use a variable weight (5). For example a container having an open topside and a valve or tray on its underside. A fluid such as a liquid, or a granular substance and preferably within such elements as synthetic or natural oil, mercury, water, sand, metal, glass or polymer beads, etc. may be introduced in the container to create the required mass.

The aforementioned piston (5) being firmly held by a cable (29) to the carriage (50) moving in or on and along the lateral arm (38) and forcing the attachment block (30) to remain at the same distance from the carriage (50) no matter its position along the arm (38).

Although a preferred embodiment of the invention has been described in detail herein and illustrated in the accompanying figures, it is to be understood that the invention is not limited to this precise embodiment and that various changes and modifications may be effected therein without departing from the scope or spirit of the present invention.

What is claimed is:

1. System for lifting and moving an object from one point to another, said system comprising:

a. a partially hollow post having a generally vertical axis;

b. a weight disposed within said post and defining a post chamber thereunder, said post chamber being fillable with a pressurized fluid;

c. a weight displacement system longitudinally and upwardly displacing the weight relative to said post, said weight displacement system controlling pressure inside said post chamber so as to selectively position said weight along said post;

d. a transversal arm rotatably connected to said post for rotation about said vertical axis and including a proximal longitudinal end located near said post and a distal longitudinal end located away from said post;

e. a cable having one end attached to said weight and the other end attached to said distal end of the transversal arm;

f. a carriage connecting to said cable and mounting on said transversal arm; and g. an object attachment member connecting to said cable for attaching the object thereto;

whereby the object is being lifted via said cable upon downward displacement of said weight relative to said post under gravity and being lowered upon upward displacement of said weight relative to said post under pressurized fluid within said post chamber.

2. System as described in claim 1 comprising at least one elongated support having one end moveably connected to said post and the other end fixed to said transversal arm.

3. System as described in claim 2 wherein said one end moveably connected to said post is rollably mounted thereon so as to move in a tangential direction relative thereto about said vertical axis.

4. System as described in claim 3 wherein said one end moveably connected to said post is attached to a rolling block, said rolling block being in rolling engagement with said post so as to roll in a tangential direction relative thereto about said vertical axis.

5. System as claimed in claim 1 further comprising an arm connecting system mounted on said proximal end of said transversal arm for rotatably connecting said transversal arm to said post about the vertical axis thereof.

6. System as claimed in claim 1 wherein said transversal arm is rotatably connected to said post for 360° movement therearound.

7. System as claimed in claim 1 wherein said weight displacement system includes a valve connected to said post chamber for controlling pressure therein.

8. System as claimed in claim 7 wherein said valve is mounted on a lower longitudinal end of said post.

9. System as claimed in claim 8 wherein said valve is connectable to a pressurized fluid source for selectively increase pressure inside said post chamber.

10. System as claimed in claim 9 wherein said pressurized fluid is pressurized air.

11. System as claimed in claim 10 wherein the pressure within said post chamber is equal or less than about four pounds per square inch (4 PSI).

12. System as claimed in claim 1 wherein the weight is used as a piston and includes a sealing member between the piston and the post.

13. System as claimed in claim 12 wherein said sealing member has an opening extending therethrough, said opening having a predetermined area to allow pressurized fluid to flow there through away from said post chamber so as to at least partially reduce friction between said weight and said post.

14. System as claimed in claim 1 wherein said transversal arm includes a rail connected thereto, said carriage being freely displaceable along said rail.

15. System as claimed in claim 14 in which said carriage is configured to maintain said object attachment member at a constant distance relative thereto during displacement of said carriage along said rail.

16. System as claimed in claim 15 in which said carriage includes a plurality of cable pulleys freely rollably mounted thereon and connecting to said cable.

17. System as claimed in claim 16 wherein said carriage includes two cable pulleys engaged by said cable, said two cable pulleys being positioned in a coplanar relationship relative to one another.

18. System as claimed in claim 15 wherein said carriage includes two rollers engaging said rail, said two rollers being positioned in a coaxial relationship relative to one another.

19. System as claimed in claim 1 wherein said transversal arm is oriented in a generally perpendicular relationship relative to said post.

20. System as claimed in claim 1 wherein said transversal arm is rotatably connected to said post for unlimited continuous movement therearound about said vertical axis.

* * * * *